US007410015B2

(12) United States Patent
Denoix

(10) Patent No.: US 7,410,015 B2
(45) Date of Patent: Aug. 12, 2008

(54) EXPANDABLE DRILL BIT

(75) Inventor: Henri Denoix, Chatenay Malabry (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/550,264

(22) Filed: Oct. 17, 2006

(65) Prior Publication Data

US 2007/0102195 A1 May 10, 2007

(51) Int. Cl.
*E21B 10/32* (2006.01)

(52) U.S. Cl. ..... 175/265; 175/263

(58) Field of Classification Search ..... 175/263, 175/265, 291, 292
See application file for complete search history.

(56) References Cited

U.S. PATENT DOCUMENTS 1,467,480 A * 9/1923 Hogue ..... 175/263
2,654,576 A * 10/1953 Kammerer ..... 175/290
2,705,129 A * 3/1955 Menton et al. ..... 175/263
3,236,320 A * 2/1966 Russ ..... 175/263
4,031,972 A * 6/1977 Burg ..... 175/263
5,494,121 A * 2/1996 Nackerud ..... 175/263
2002/0050408 A1* 5/2002 Nackerud ..... 175/67
2003/0183424 A1* 10/2003 Tulloch ..... 175/263

FOREIGN PATENT DOCUMENTS

GB 2275067 A * 8/1994
SU 501139 A * 10/1976

* cited by examiner

*Primary Examiner*—Jennifer H Gay
*Assistant Examiner*—Daniel P Stephenson
(74) *Attorney, Agent, or Firm*—Jaime Castano

(57) ABSTRACT

An expandable drill bit comprises a body for mounting on a support string DS, a plurality of drill arms 3A, 3B, 3C, 3D, 4A, 4B, 4C, 4D coupled to the body and extending along a central longitudinal axis LL', and at least one drill arm supporting cutting elements 6A. The plurality of drill arms 3A, 3B, 3C, 3D, 4A, 4B, 4C, 4D are pivotable between a retracted configuration and an expanded configuration. The retracted configuration defines an expandable drill bit having a first cutting diameter D1. The expanded configuration defines an expandable drill bit having a second cutting diameter D2 greater than the first cutting diameter. The drill arms 3A, 3B, 3C, 3D, 4A, 4B, 4C, 4D are driven from the retracted configuration into the expanded configuration when the expandable drill bit is rotated at a speed of rotation at least equal to a determined expanding speed of rotation.

12 Claims, 5 Drawing Sheets

EXPANDABLE DRILL BIT

FIELD OF THE INVENTION

The invention relates to an expandable drill bit.

The drill bit of the invention can be used for drilling bores, namely creating bore or performing subsequent drilling operations in an existing bore. The invention finds a particular application in the oilfield industry.

BACKGROUND OF THE INVENTION

FIG. 1 schematically shows a typical onshore hydrocarbon well location and surface equipments SE above a hydrocarbon geological formation GF after some well-bore WB drilling operations have been carried out.

A first portion P1 of the well-bore is a cased portion. A casing string CS has been run into this first portion of the well-bore. Cementing operations have been carried out, in this first portion, for sealing the annulus CA (i.e. the space between the well-bore WB and the casing string CS). A second portion P2 of the well-bore is an open bore hole. A third portion P3 of the well-bore is a sensibly horizontal lateral bore hole. These various portions of the well-bore have various diameters.

Typically, the surface equipments SE comprise a plurality of mud tanks and mud pumps, a derrick, a drawworks, a rotary table, a power generation device and various auxiliary devices, etc. . . . A drill string DS couples the surface equipments with a drilling assembly DA. The drilling assembly comprises a drill bit DB. Typically, the drill string and the drilling assembly comprise an internal conduit through which a drilling fluid flow circulates.

After the first portion P1 of the well-bore has been drilled, the drilling assembly may be used to further drill the well-bore hole, for example the second portion P2 and/or the third portion P3. In addition, the drilling assembly may be move in and out of the well-bore hole in the event of failure of any part of the drilling assembly. Further, the drilling assembly when moved into the well-bore hole should be able to go through hole restrictions without being blocked.

Thus, there is a need to be able to adapt the diameter of the drilling bit DB1, DB2 and DB3 in order to pass through the various portions of the well-bore P1, P2 and P3, respectively.

The document WO01/81708 describes an expandable drill bit for use with earth drilling equipment. The bit includes arms held in a closed configuration, so that the bit may be inserted through casing or a small bore hole. The arms are expandable to create an expanded drill bit having a crown profile common to a solid crown bit. The arrangement of the arms provides a short gauge length so that the expanded bit is steerable downhole. The expandable drill bit comprises mechanisms for actuating the arms between the open and closed configurations. It appears that the expandable drill bit can be extended by using hydraulic force and/or latching mechanism. A limitation associated with this expandable drill bit is the need to control pressure or flow for activating the bit expansion/retraction. Another limitation associated with this expandable drill bit is that the shape of the bit is not adapted for use with low flow circulation. In case of low flow circulation (reverse or standard circulation), the fluid velocity may not be sufficient for cleaning the bit, resulting in failure due to cuttings getting stuck.

SUMMARY OF THE INVENTION

It is an object of the invention to propose an expandable drill bit that overcomes at least one of the drawbacks of the prior art, in particular an expandable drill bit which is adapted for drilling even with low flow rate.

According to the invention, an expandable drill bit is proposed that expands when rotating and retracts when not rotating. The expanded configuration is obtained due to the effect of centrifugal forces at a determined rotation speed. The drill bit may be further locked in when weight is applied on the drill bit. The retracted configuration is obtained when rotation speed is reduced under the determined rotation speed and when an appropriate axial force is applied to the drill bit.

According to an aspect, the invention relates to an expandable drill bit comprising a body for mounting on a support string, a plurality of drill arms coupled to the body and extending along a central longitudinal axis, at least one drill arm supporting cutting elements. The plurality of drill arms are pivotable between a retracted configuration and an expanded configuration, the retracted configuration defining an expandable drill bit having a first cutting diameter, the expanded configuration defining an expandable drill bit having a second cutting diameter greater than the first cutting diameter. The arms are driven from the retracted configuration into the expanded configuration when the expandable drill bit is rotated at a speed of rotation at least equal to a determined expanding speed of rotation.

The arms may be blocked into one of the configurations when a weight is further applied on the expandable drill bit.

According to a further aspect, the drill arms of the expandable drill bit of the invention comprise at least two main drill arms, and at least two intermediate drill arms, the main drill arms defining an end of a drill bit internal conduit coaxial to the central longitudinal axis. In the retracted configuration, each main drill arm contacts another main drill arm, and the intermediate drill arms is positioned within the end of the drill bit internal conduit. In the expanded configuration, the main drill arms and the intermediate drill arms pivot laterally so that each intermediate drill arm fits between two main drill arms.

According to another aspect, the body comprises an opened annular cavity coaxial to the central longitudinal axis between the drill bit internal conduit and an external drill bit body wall, and each drill arm comprises an upper portion and a lower portion pivotable within the opened annular cavity.

The cavity may comprise an annular groove, and the lower portion of the drill arms may have a profile corresponding to the annular groove so that when a weight is applied on the expandable drill bit into the expanded configuration, the lower portion fits within the annular groove to block the drill arms.

Optionally, the cavity may further comprise a second annular groove concentric to the annular groove. The profile of the lower portion of the drill arms corresponds to the second annular groove so that when a weight is applied on the expandable drill bit into the retracted configuration, the lower portion fits within the second annular groove to block the drill arms.

The cavity may further comprise at least one recess, and an elastic element engaged by one of its end into the recess and acting on at least one of the drill arms so that the action of the elastic element facilitate the arms pivoting from the expanded configuration into the retracted configuration.

According to still another aspect, each drill arm further comprises a peripheral groove, and the cavity comprises a reduced size opening cooperating with the peripheral groove so that the lower portion of the drill arms are maintained into the cavity.

Optionally, the lower portion of the drill arm may have a tilted profile in cross-section, the thickness of the drill arm reducing towards a lower portion extremity.

According to still another aspect, the expandable drill bit may further comprise a ring around the external face of the arms so that the drill arms move simultaneously.

The ring may be positioned within the peripheral groove of the drill arms.

According to still a further aspect, each main drill arm further comprises a first lateral side and a second lateral side, the second lateral side being opposite to the first lateral side, the first lateral side comprising a lateral slot and the second lateral side comprising another lateral slot. In the retracted configuration, each intermediate drill arm is imbricated within two contacting main drill arms, one lateral side of the intermediate drill arm fitting within the lateral slot of a first main drill arm and the other lateral slot of a second main drill arm.

With the expandable drill bit of the invention, it is possible to adapt the drill bit diameter to the hole internal diameter. In particular, the expandable drill bit can be expanded when rotating in order to drill hole. Thus, the expandable drill bit can be use to drill re-entry lateral holes with diameter larger than the minimum diameter of cased well-bore or of any completion assembly in which the drill bit has to go through. The expandable drill bit may be retracted when not rotating in order to facilitate tripping in and out of the hole.

The expandable drill bit of the invention also allows drilling of holes with different types of drilling system. In particular, the expandable drill bit can be used with drilling systems which can control the exact amount of axial force (or weight on bit) applied to the bit.

Further, with the invention, the expandable drill bit is not limited in the amount of fluid flow available during drilling In particular, the expandable drill bit is well adapted for drilling when only low fluid flow rate is available (with reverse of standard circulation).

According to a further aspect, the invention relates to a drilling system.

The drill bit system comprises a rotating device, a support string and an expandable drill bit which are coupled together. The expandable drill bit comprises a body mounted on the support string, a plurality of drill arms coupled to the body and extending along a central longitudinal axis, at least one drill arm supporting cutting elements, the plurality of drill arms are pivotable between a retracted configuration and an expanded configuration, the retracted configuration defining an expandable drill bit having a first cutting diameter, the expanded configuration defining an expandable drill bit having a second cutting diameter greater than the first cutting diameter. The arms are driven from the retracted configuration into the expanded configuration when the rotating devices rotates the expandable drill bit at a speed of rotation at least equal to a determined expanding speed of rotation.

The expandable drill bit of the invention is adapted to be use in a drilling system comprising an electrical motor as a rotating device.

The invention is particularly well adapted when used for lateral re-entry drilling in existing production wells by means of a through tubing drilling. A through tubing drilling is an intervention consisting in leaving the production tubing string in place, and having the drilling system run through the minimum internal diameter of the tubing (refer to WO 2004/011766 for details on drilling well bore from an existing well bore). Such an intervention allows reducing the cost of lateral holes. Typically, through tubing drilling can be performed with full electrical bore-hole assembly.

These and other aspects of the invention will be apparent from and elucidated with reference to the embodiments described hereinafter.

BRIEF DESCRIPTION OF THE DRAWINGS

The present invention is illustrated by way of example and not limited to the accompanying figures, in which like references indicate similar elements.

DETAILED DESCRIPTION OF THE INVENTION

FIGS. 2, 3, 4 and 5 show the expandable drill bit of the invention into a retracted configuration.

Figure 1:
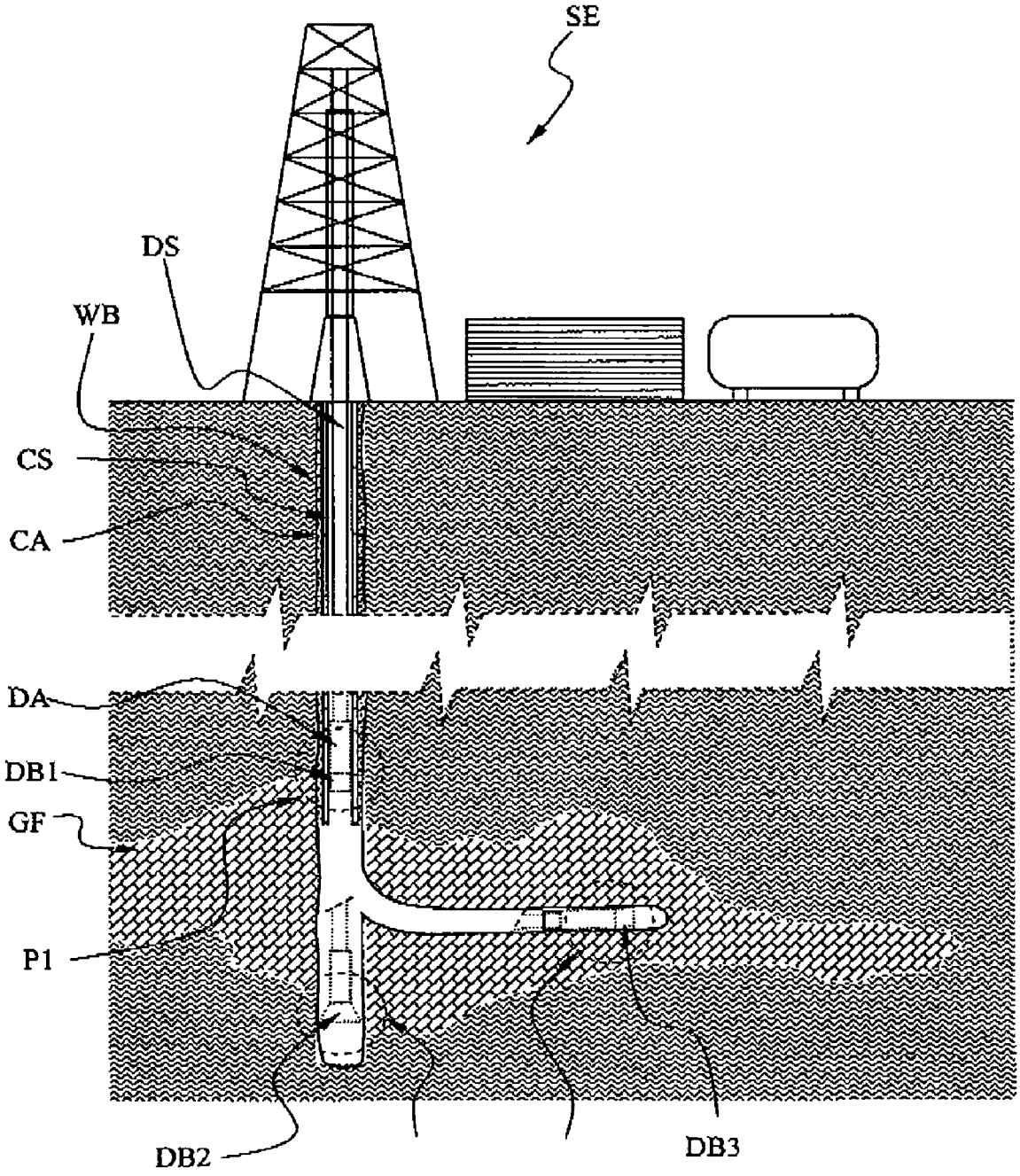
FIG. 1 is a highly schematical view of a typical onshore hydrocarbon well location and surface equipments above a hydrocarbon geological formation.
Figure 2:
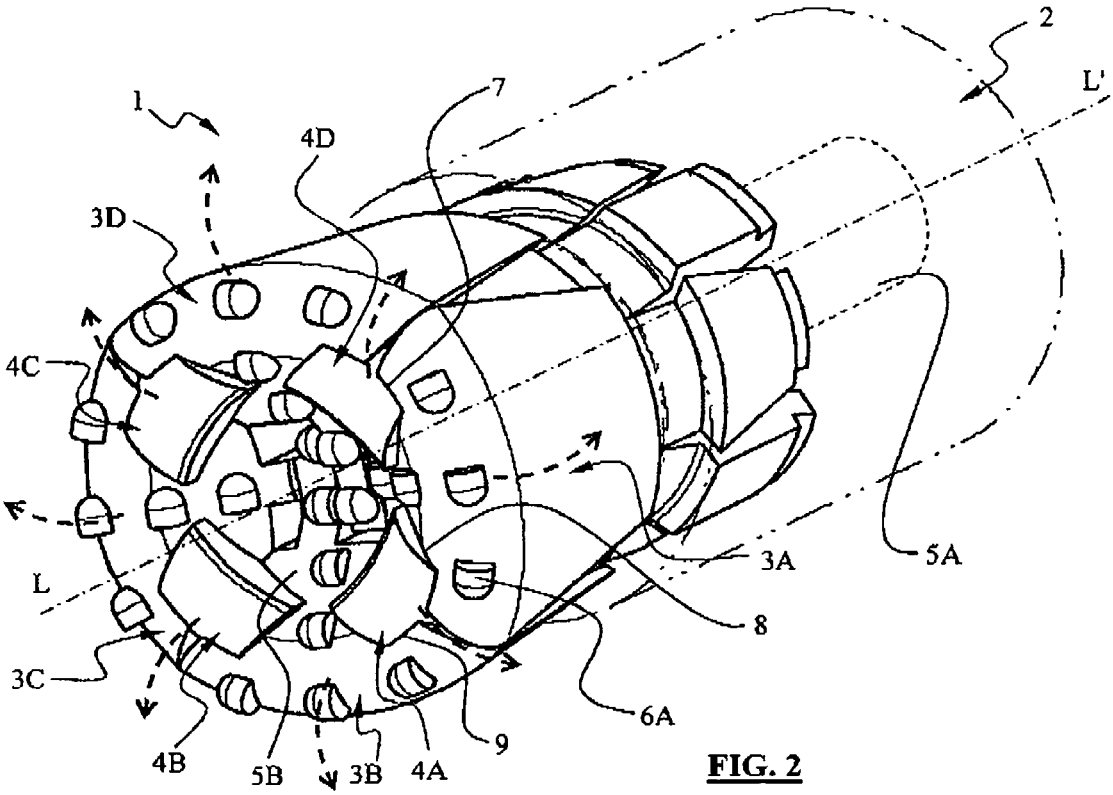
FIG. 2 is a perspective view partially showing the expandable drill bit of the invention into a retracted configuration.
Figure 3:
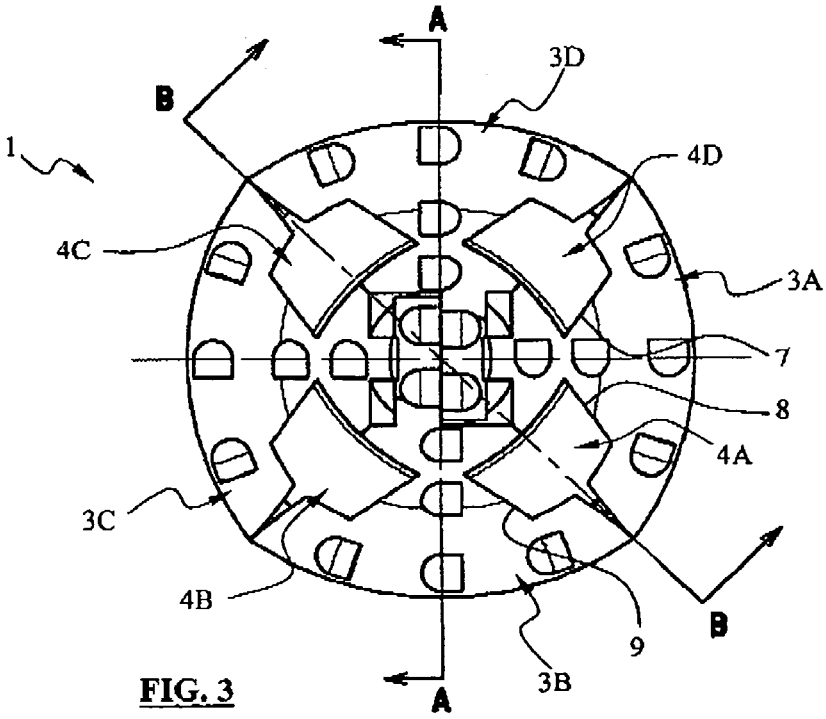
FIG. 3 is an underneath view showing the drilling arms of the expandable drill bit of the invention into a retracted configuration.

FIG. 2 partially shows the expandable drill bit of the invention into a retracted configuration according to a perspective view. FIG. 3 shows an extremity of the expandable drill bit of the invention into a retracted configuration according to an underneath view.

The expandable drill bit 1 comprises a body 2 and a plurality of drill arms 3A, 3B, 3C, 3D, 4A, 4B, 4C and 4D.

In FIG. 2, the body 2 is depicted in broken lines for drawing clarity reason. The body 2 comprises an extremity which is adapted for mounting on a support string, for example a threaded extremity (not shown). The body 2 comprises an internal conduit 5A coaxial to the central longitudinal axis LL'. The internal conduit is depicted in dotted lines for drawing clarity reason. Typically a drilling fluid is circulated through the support string and the drill bit internal conduit.

The plurality of drill arms are coupled to the body and extends along a central longitudinal axis LL'. The plurality of drill arms may pivot laterally relatively to the body according to directions perpendicular to the central longitudinal axis LL'.

In the example of FIG. 2, the drill arms comprise four main drill arms 3A, 3B, 3C and 3D, and four intermediate drill arms 4A, 4B, 4C and 4D.

Each main drill arm has a general T-shape cross-section (according to a plan substantially perpendicular to the central longitudinal axis LL'). Advantageously, each main drill arm further comprises a first lateral slot and a second lateral slot. The first and second lateral slots are positioned under the horizontal portion of the T-shape along a first and a second lateral side, respectively. The second lateral side is opposite to the first lateral side. They are substantially parallel to the central longitudinal axis LL' in the retracted configuration.

Each main drill arm supports at least one cutting element, for example a plurality of cutting elements 6A. Advantageously, the cutting elements are located at the upper portion of each main drill arm which is intended for contacting/drilling the underground material. Preferably, the cutting elements are made of a hard material, typically carbide or diamond, which is able to drill the various geological material encountered in the underground. In the retracted position, the main drill arm are arranged to permit the cutting elements to contact/drill the underground material facing the expandable drill bit and not ream the well bore wall or surrounding casing.

The main drill arms define a drill bit internal conduit end portion 5B coaxial to the central longitudinal axis LL' and in continuity with the body internal conduit 5A. Advantageously, there is not any opening between the annulus and the internal conduit. This feature combined with a controllable section of fluid flow on the cutting face of the drill bit allows an efficient cleaning of the bit and an efficient transport of the cuttings.

Each intermediate drill arm has a shape that fits at least partially within a main drill arm lateral slot.

In the retracted configuration, each main drill arm contacts two other main drill arms. For example, the first main drill arm 3A contacts the second main drill arm 3B and the fourth main drill arm 3D; the second main drill arm 3B further contacts the third main drill arm 3C; the third main drill arm 3C further contacts the fourth main drill arm 3D. More precisely, regarding the first main drill arm 3A, the first lateral side of the first main drill arm 3A contacts with a lateral side of the second main drill arm 3B. Further, the second lateral side of the first main drill arm 3A contacts with a lateral side of the fourth main drill arm 3D. An analogous positioning applies for the other main drill arms 3B, 3C and 3D and will not be further described. Advantageously, the contacting area between two main drill arms is limited to the extremity of the lateral side of the main drill arm.

In the retracted configuration, the intermediate drill arms are positioned within the drill bit internal conduit end portion 5B. The intermediate drill arms are imbricated within two contacting main drill arms. In particular, one lateral side of each intermediate drill arm fits within a first main drill arm lateral slot and a second main drill arm lateral slot. For example, the intermediate drill arm 4A fits within the second slot 8 of the first main drill arm 3A and a first slot 9 of the second main drill arm 3B. An analogous positioning applies for the other intermediate drill arms 4B, 4C and 4D and will not be further described.

Figure 4:
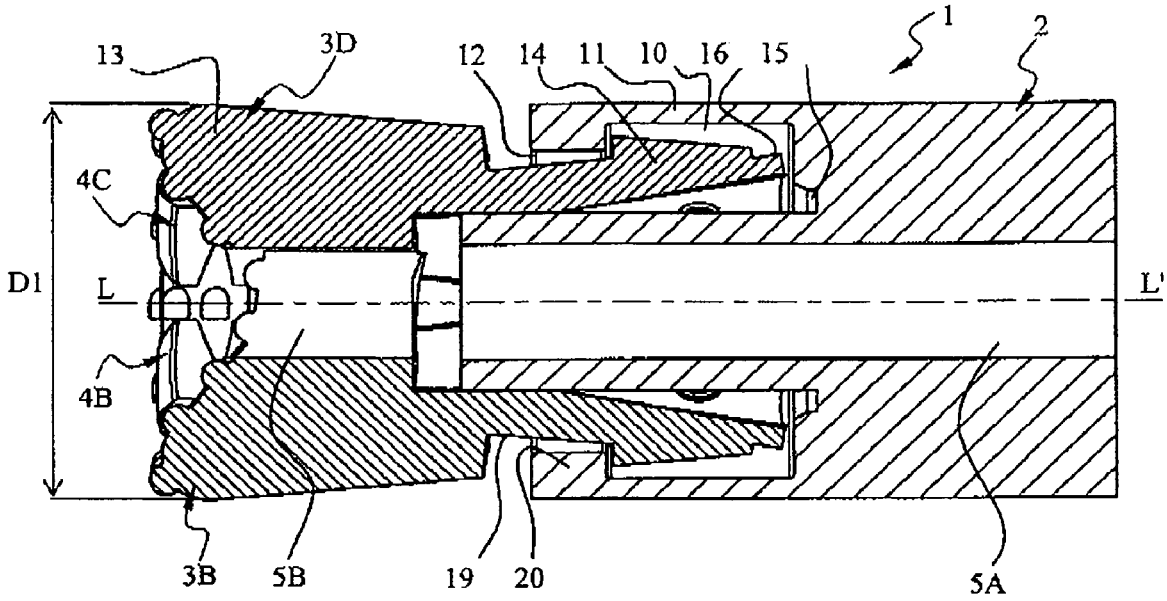
FIG. 4 is a cross-section view along line AA of FIG. 3 showing the expandable drill bit of the invention into a retracted configuration.

In the retracted configuration, the expandable drill bit has a first cutting diameter D1 (see FIG. 4). The first cutting diameter is substantially equivalent to the diameter of the body 2. For example, the first cutting diameter D1 is around 3.5 inches.

FIG. 4 shows the expandable drill bit of the invention into a retracted configuration according to a cross-section view along line AA of FIG. 3. Two main drill arms 3B and 3D are shown in FIG. 4.

Figure 5:
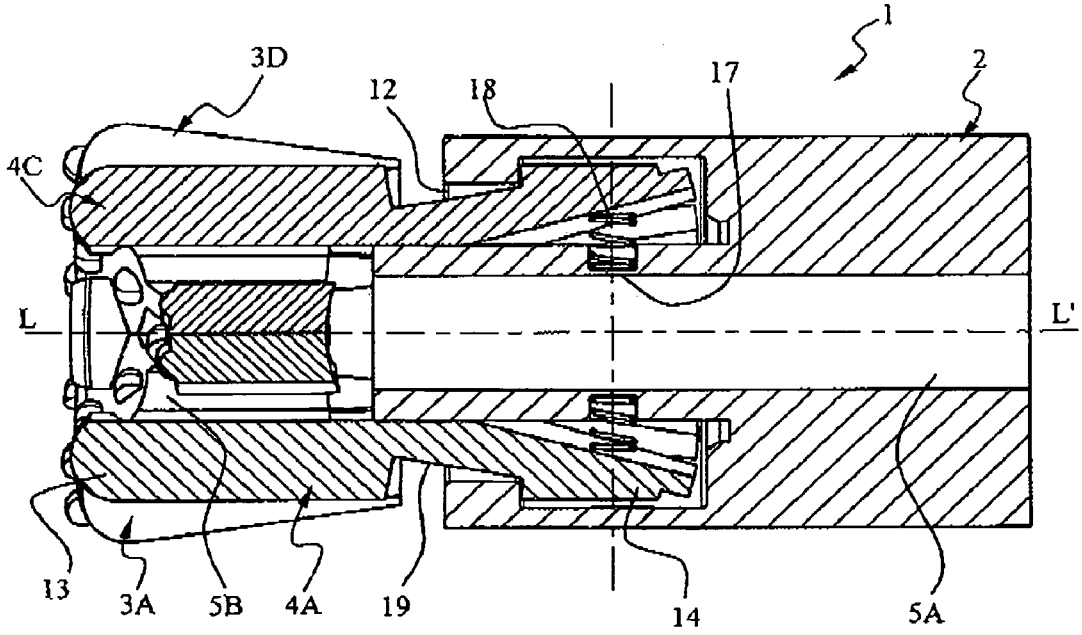
FIG. 5 is a cross-section view along line BB of FIG. 3 showing the expandable drill bit of the invention into a retracted configuration.

FIG. 5 shows the expandable drill bit of the invention into a retracted configuration according to a cross-section view along line BB of FIG. 3. Two intermediate drill arms 4A and 4C are shown in FIG. 5.

The body 2 comprises an opened annular cavity 10 coaxial to the central longitudinal axis LL'. The cavity 10 is positioned between the drill bit internal conduit 5A wall and an external drill bit body wall 11. The cavity comprises a ring shaped opening 12. Advantageously, the cavity 12 comprises an annular rim 20 defining an opening having a reduced size relatively to the cavity size.

The cavity 10 comprises an annular groove 15. Advantageously, the annular groove 15 is located at a bottom of the cavity facing the ring shaped opening 12.

Each drill arm, namely each main drill arm and each intermediate drill arm, comprises an upper portion 13 and a lower portion 14. The upper portion 13 is a portion of the drill arm directed towards the area to be drilled. The lower portion is a portion of the drill arm which is inserted into the opened annular cavity and pivotable within this cavity.

The extremity of the lower portion of the drill arms have a profile 16 corresponding to the annular groove 15. More precisely, the profile 16 of the lower portion extremity is adapted to fit within the annular groove 15 of the cavity.

Each drill arm, namely each main drill arm and each intermediate drill arm, comprises a peripheral groove 19. The peripheral groove is located between the lower portion and the upper portion of the drill arm. The peripheral groove cooperates with the reduced size opening so that the lower portion of each drill arm is maintained into the cavity.

Advantageously, the lower portion 14 of the drill arm has a tilted profile in cross-section (according to a plan substantially parallel to the longitudinal axis LL'). The thickness of the drill arm reduces towards the lower portion extremity. Thus, during the expandable drill bit manufacturing process, each drill arm lower portion can be easily inserted into the cavity. Further, when in use and when the expandable drill bit is in the retracted configuration, the rim 20 of the cavity opening forms an abutment for the lower portion 14. Therefore, the risk of any drill arm getting out of the cavity is avoided, at least limited.

As a consequence of the hereinbefore described design of the drill arms, the upper portion 13 is heavier than the lower portion 14 of the drill arm. The peripheral groove 19 constitutes a pivoting area.

Advantageously, the expandable drill bit may further comprise a ring (not shown) around the external face of the drill arms. The ring may ensure that the drill arms move simultaneously when the expandable drill bit is moving axially. Advantageously, the ring is positioned within the peripheral groove 19 of the drill arms. Advantageously, the ring is made of an elastic material.

The cavity further comprises at least one recess 17. Advantageously, a plurality of recess is regularly spaced into the wall between the cavity 10 and the internal conduit 5A. The recesses are directed towards the cavity interior. Preferably, each recess faces a drill arms. In the example of FIG. 5, a recess is facing each lower portion of an intermediate drill arm 4A, 4C. At least one elastic element 18 is engaged by one of its end into the recess 17 and acts on at least one of the intermediate drill arm. The action of the elastic element facilitates the drill arms pivoting from the expanded configuration into the retracted configuration and/or helps maintaining the retracted configuration. The elastic element applies a determined resilient force which participates in defining an expanding speed of rotation. Advantageously, each elastic element applies a different determined resilient force in order to allow a proper relative movement of the drill arms when moving from the retracted configuration into the expanded configuration and vice-versa.

The elastic element 18 may be, for example, a spring, a piece of resilient material, etc. . . .

Optionally, the cavity may comprise a second annular groove (not shown on the drawing) for blocking the drill bit in the retracted configuration. The second annular groove is concentric to the annular groove 15. The profile 16 of the extremity of the lower portion of the drill arms corresponds to the second annular groove. More precisely, the profile 16 of the lower portion extremity is adapted to fit within the second annular groove. When a weight is applied on the expandable drill bit in the retracted configuration, the lower portion fits within the second annular groove to block the drill arms. Thus, in the retracted configuration, a greater stability of the drill bit is achieved when axial force is applied to the bit before the bit is rotated.

FIGS. 6, 7, 8 and 9 show the expandable drill bit of the invention into an expanded configuration.

Figure 6:
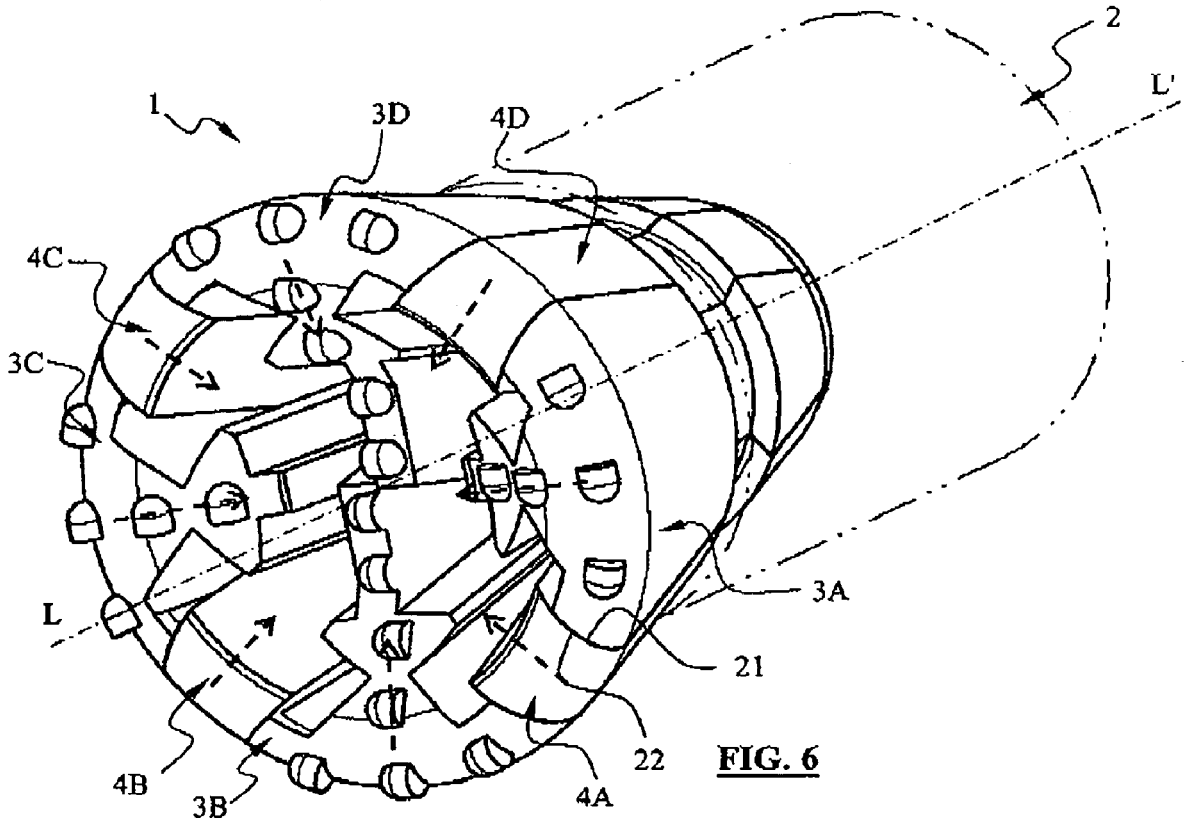
FIG. 6 is a perspective view partially showing the expandable drill bit of the invention into an expanded configuration.
Figure 7:
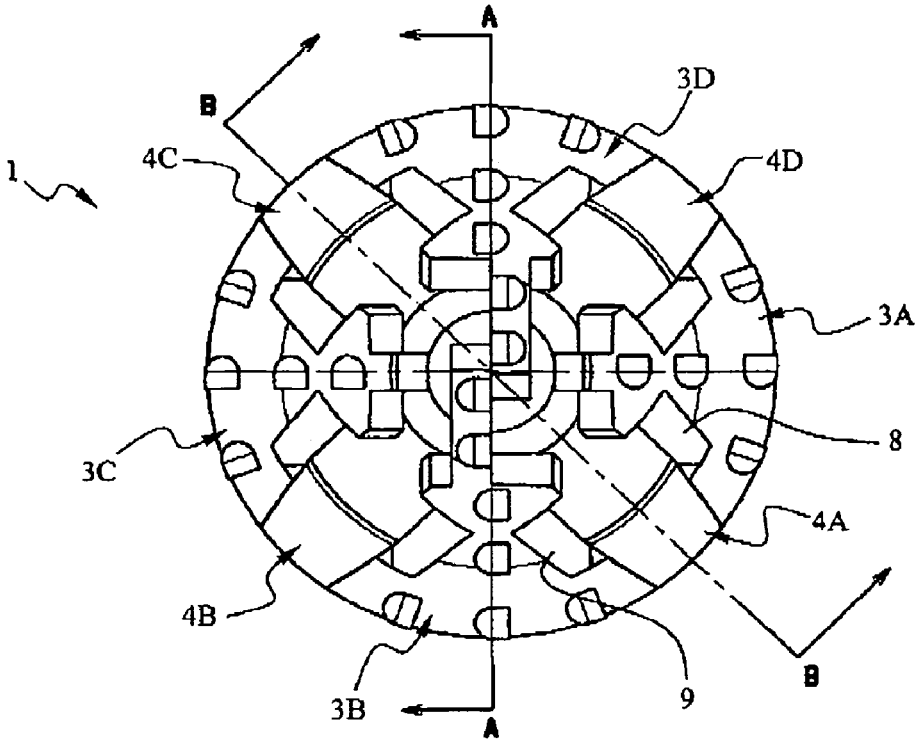
FIG. 7 is an underneath view showing the drilling arms of the expandable drill bit of the invention into an expanded configuration.

FIG. 6 partially shows the expandable drill bit of the invention into an expanded configuration according to a perspective view. FIG. 7 shows an extremity of the expandable drill bit of the invention into an expanded configuration according to an underneath view.

Figure 8:
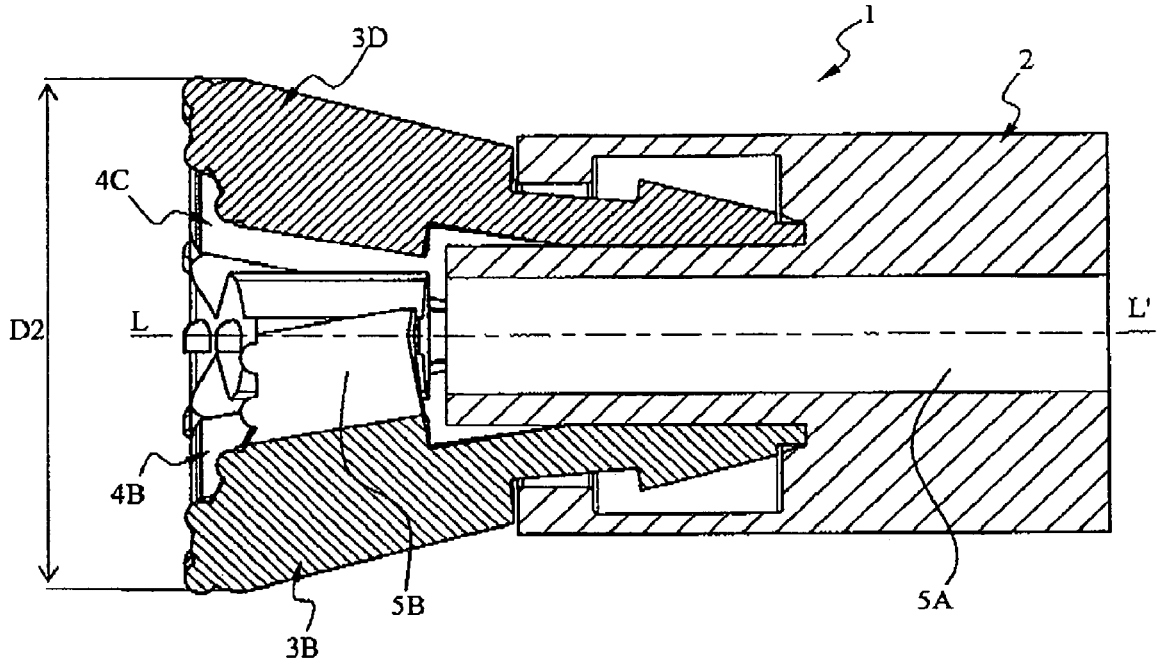
FIG. 8 is a cross-section view along line AA of FIG. 3 showing the expandable drill bit of the invention into an expanded configuration.

FIG. 8 shows the expandable drill bit of the invention into an expanded configuration according to a cross-section view along line AA of FIG. 7. Two main drill arms 3B and 3D are shown in FIG. 8.

Figure 9:
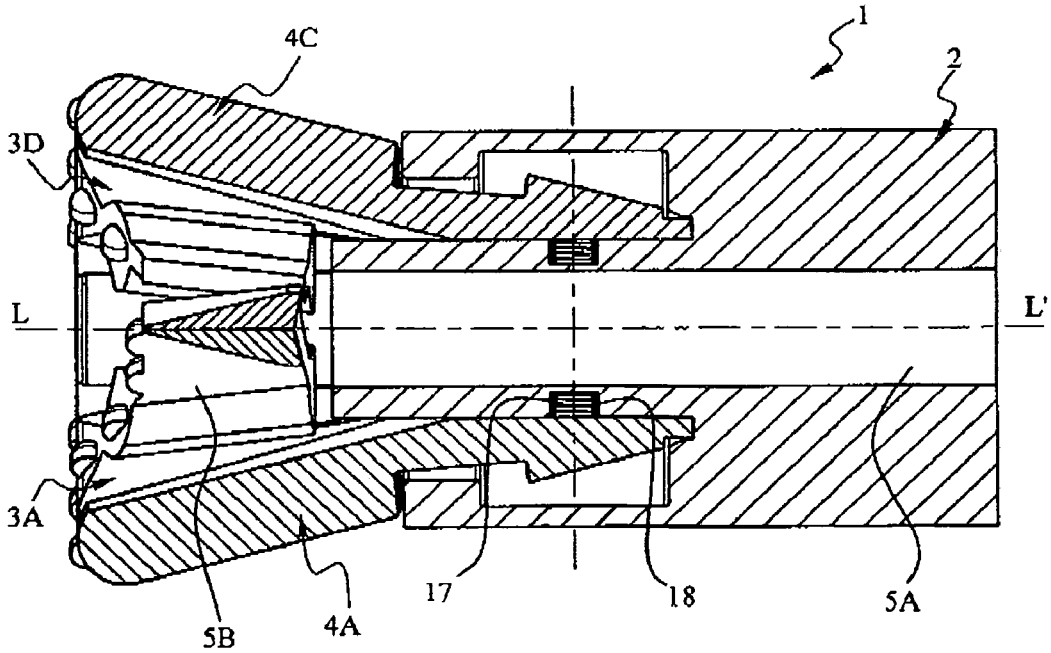
FIG. 9 is a cross-section view along line BB of FIG. 3 showing the expandable drill bit of the invention into an expanded configuration.

FIG. 9 shows the expandable drill bit of the invention into an expanded configuration according to a cross-section view along line BB of FIG. 7. Two intermediate drill arms 4A and 4C are shown in FIG. 9.

During an expansion phase, the expandable drill bit is operated from the retracted configuration into the expanded configuration as hereinafter described.

When the expandable drill bit is rotated at a speed of rotation at least equal to a determined expanding speed of rotation, the arms are driven outwardly from the retracted configuration into the expanded configuration (see arrows in broken lines in FIG. 2). Each drill arm moves in a direction perpendicular to the central longitudinal axis LL'. Each drill arm pivots around the pivoting area defined by the rim 20 of the cavity opening 12 and the peripheral groove 19. Thus, the drill arms can pivot within the cavity without the need to be attached by e.g. a plurality of hinge pins.

More precisely, when the determined expanding speed of rotation is reached, the centrifugal forces push the upper portion of the drill arms, namely the heavy portion of the drill arms outwardly. Further, the elastic elements 18 are compressed in their respective recesses 17.

The determined expanding speed of rotation mainly depends on various parameters, e.g. the size and weight of the arms, the position of the pivoting area and the force of the elastic elements. The determined expanding speed of rotation can be adjusted in order to fit the characteristic of the drilling system into which the expandable drill bit of the invention is coupled.

When moving into the expanded configuration, the relative movement of the drill arms is such that each intermediate drill arm leaves the lateral slots of the main drill arms and fits between two main drill arms. For example, the first intermediate drill arm 4A leaves the slots 8 and 9 of the first 3A and second 3B main drill arms, respectively and fits between them.

In the present example, at the end of the expansion phase, the first intermediate drill arm 4A is imbricated between the first 3A and the second 3B main drill arm; the second intermediate drill arm 4B is imbricated between the second 3B and the third 3C main drill arm; the third intermediate drill arm 4C is imbricated between the third 3C and the fourth 3D main drill arm; and the fourth intermediate drill arm 4A is imbricated between the fourth 3D and the first 3A main drill arm. A crown expandable drill bit is formed due to the expansion of the T-shape main drill arms 3A, 3B, 3C and 3D.

Then, by applying an axial force, e.g. a weight to the expandable drill bit, for example when a drilling operation is started, all the drill arms are pushed backward towards the bottom of the cavity. The profile 16 of the extremity of the lower portion of each drill arm inserts itself in the annular groove 15 (see FIGS. 8 and 9). As a consequence, the drill arms are blocked into the expanded configuration and the drill arms are kept from retracting. The drills arms are rigidly maintained in position whatever the effort applied axially or laterally on the expandable drill bit, and whatever the drill bit rotation direction during the drilling operations. The ring (not shown) helps keeping all the drill arms moving simultaneously in the axial direction.

Each elastic element 18 may apply a different resilient force onto the associated drill arm so as to allow the proper relative movement of the drill arms during the expansion phase.

Preferably, the geometry of each drill arm is designed to produce minimum friction forces during the drill arms relative movements. In particular, each main drill arm and each intermediate drill arm have associated contacting faces, for example the contacting face 21 of the first main drill arm 3A is associated with the contacting face 22 of the intermediate drill arm 4A. These contacting faces are beveled and flat for facilitating their relative movements. The same characteristic applies to the other drill arms and will not be further described. Thus, in the expanded configuration, there is a continuity of the cutting surface, avoiding that cuttings gather between the drill arms in the area of the contacting faces.

In the expanded configuration, the drill bit internal conduit end portion 5B communicates largely with the body internal conduit 5A. This ensures a good control of the circulation of drilling fluid injected into the expandable drill bit during drilling operations. The drill bit shape when expanded is well adapted to drilling with low flow rate because there is no opening between the well-bore annulus and the body internal conduit 5A.

In the expanded configuration, the expandable drill bit defines a second cutting diameter D2 (see FIG. 8). The second cutting diameter is greater than the diameter of the body 2. For example, the second cutting diameter D2 is around 4.5 inches.

The expandable drill bit is operated from the expanded configuration into the retracted configuration as hereinafter described.

Firstly, the drill arms are disengaged from the annular grove, namely the profile 16 of the extremity of the lower portion of each drill arm is pushed outside of the annular groove 15 by applying an appropriate axial force to the expandable drill bit. Then, when the expandable drill bit is rotated at a speed of rotation lower to the determined expanding speed of rotation, the action of compressed elastic element 18 onto the drill arms exceeds the centrifugal forces. The drill arms are driven inwardly (see arrows in broken lines in FIG. 6) from the expanded configuration into the retracted configuration. Each drill arm moves inwardly in a direction perpendicular to the central longitudinal axis LL'. Each drill arm pivots around the pivoting area defined by the rim 20 of the cavity opening 12 and the peripheral groove 19.

When moving into the retracted configuration, the relative movement of the drill arms is such that each intermediate drill arm fits into two facing lateral slots of the main drill arms.

At this stage, the elastic elements 18 keep the expandable drill bit in the retracted configuration by pushing at least some of the drill arms.

In the retracted configuration, the expandable drill bit can be run in hole or casing with a diameter slightly above the first cutting diameter D1. Thus, the tripping of the drill string when moving in the hole/casing is facilitated.

FINAL REMARKS

The hereinbefore described embodiment of the invention illustrates an expandable drill bit comprising four main drill arms and four intermediate drill arms. However, it will be apparent from a person skilled in the art that the expandable drill bit according to the invention is not limited to this particular embodiment and that at least two main drill arms and two intermediate drill arms are necessary. Further, the invention is not limited to the particular number and position of the cutting elements depicted in the drawings.

Though the invention has been described in relation with a particular example of onshore hydrocarbon well location, it will also be apparent for a person skilled in the art that the invention is applicable to offshore hydrocarbon well location.

The drawings and their description hereinbefore illustrate rather than limit the invention.

Any reference sign in a claim should not be construed as limiting the claim. The word "comprising" does not exclude the presence of other elements than those listed in a claim. The word "a" or "an" preceding an element does not exclude the presence of a plurality of such element.

The invention claimed is:

1. An expandable drill bit comprising:

a body for mounting on a support string, a plurality of drill arms coupled to the body and extending along a central longitudinal axis, at least one drill arm supporting cutting elements, and the plurality of drill arms being pivotable between a retracted configuration and an expanded configuration, the retracted configuration defining an expandable drill bit having a first cutting diameter, the expanded configuration defining an expandable drill bit having a second cutting diameter greater than the first cutting diameter, wherein the drill arms are driven from the retracted configuration into the expanded configuration when the expandable drill bit is rotated at a speed of rotation at least equal to a determined expanding speed of rotations, and wherein:

the drill arms comprise at least two main drill arms, and at least two intermediate drill arms, the main drill arms defining an end of a drill bit internal conduit coaxial to the central longitudinal axis, in the retracted configuration, each main drill arm contacts another main drill arm, and the intermediate drill arms are positioned within the end of the drill bit internal conduit, and in the expanded configuration, the main drill arms and the intermediate drill arms pivot laterally so that each intermediate drill arm fits between two main drill arms.

2. An expandable drill bit according to claim 1, wherein the drill arms are blocked into one of the configurations when a weight is further applied on the expandable drill bit.

3. An expandable drill bit according to claim 1, wherein:

the body comprises an opened annular cavity coaxial to the central longitudinal axis between the drill bit internal conduit and an external drill bit body wall, and each drill arm comprises an upper portion and a lower portion pivotable within the opened annular cavity.

4. An expandable drill bit according to claim 3, wherein:

the opened annular cavity comprises an annular groove, and the lower portion of the drill arms have a profile corresponding to the annular groove so that when a weight is applied on the expandable drill bit into the expanded configuration, the lower portion fits within the annular groove to block the drill arms.

5. An expandable drill bit according to claim 4, wherein:

the opened annular cavity further comprises a second annular groove concentric to the annular groove, and the profile of the lower portion of the drill arms corresponds to the second annular groove so that when a weight is applied on the expandable drill bit into the retracted configuration, the lower portion fits within the second annular groove to block the drill arms.

6. An expandable drill bit according to claim 3, wherein:

the opened annular cavity further comprises at least one recess, and an elastic element engaged by one of its end into the recess and acting on at least one of the drill arms so that the action of the elastic element facilitate the arms pivoting from the expanded configuration into the retracted configuration.

7. An expandable drill bit according to claim 3, wherein:

each drill arm further comprises a peripheral groove, and the opened annular cavity comprises a reduced size opening cooperating with the peripheral groove so that the lower portion of each drill arm is maintained into the opened annular cavity.

8. An expandable drill bit according to claim 3, wherein the lower portion of each drill arm has a tilted profile in cross-section, the thickness of the drill arm reducing towards a lower portion extremity.

9. An expandable drill bit according to claim 1, wherein the expandable drill bit further comprises a ring around the external face of the drill arms so that the drill arms move simultaneously.

10. An expandable drill bit according to claim 9, wherein the ring is positioned within a peripheral groove of the drill arms.

11. An expandable drill bit according to claim 1, wherein:

each main drill arm further comprises a first lateral side and a second lateral side, the second lateral side being opposite to the first lateral side, the first lateral side comprising a lateral slot and the second lateral side comprising another lateral slot, and in the retracted configuration, each intermediate drill arm is imbricated within two contacting main drill arms, one lateral side of the intermediate drill arm fitting within the lateral slot=of a first main drill arm and the other lateral slot of a second main drill arm.

12. A drill bit system comprising a rotating device, a support string and an expandable drill bit which are coupled together, wherein the expandable drill bit comprises:

a body mounted on the support string, a plurality of drill arms coupled to the body and extending along a central longitudinal axis, at least one drill arm supporting cutting elements, the plurality of drill arms are pivotable between a retracted configuration and an expanded configuration, the retracted configuration defining an expandable drill bit having a first cutting diameter, the expanded configuration defining an expandable drill bit having a second cutting diameter greater than the first cutting diameter, and wherein the arms are driven from the retracted configuration into the expanded configuration when the rotating devices rotates the expandable drill bit at a speed of rotation at least equal to a determined expanding speed of rotation, and wherein:

the drill arms comprise at least two main drill arms, and at least two intermediate drill arms, the main drill arms defining an end of a drill bit internal conduit coaxial to the central longitudinal axis, in the retracted configuration, each main drill arm contacts another main drill arm, and the intermediate drill arms are positioned within the end of the drill bit internal conduit, and in the expanded configuration, the main drill arms and the intermediate drill arms pivot laterally so that each intermediate drill arm fits between two main drill arms.

* * * * *